US006991850B2

(12) United States Patent
Hurst et al.

(10) Patent No.: US 6,991,850 B2
(45) **Date of Patent: *Jan. 31, 2006**

(54) LOAD LEVELING YARNS AND WEBBINGS

(75) Inventors: David A. Hurst, Richmond, VA (US); Craig A. Trask, Chesterfield, VA (US); Tony L. Giovannetti, Richmond, VA (US)

(73) Assignee: Performance Fibers, Inc., Moncure, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/754,397

(22) Filed: Jan. 9, 2004

(65) Prior Publication Data

US 2005/0153131 A1 Jul. 14, 2005

(51) Int. Cl.

| | |
|---|---|
| ***D01F 6/00*** | (2006.01) |
| ***D03D 15/00*** | (2006.01) |
| ***D02G 3/02*** | (2006.01) |
| ***B60R 22/28*** | (2006.01) |

(52) U.S. Cl. ..... 428/364; 57/243; 442/216; 280/805

(58) Field of Classification Search ..... 428/364; 442/216; 57/243; 280/805

See application file for complete search history.

(56) References Cited

U.S. PATENT DOCUMENTS

| | | | | |
|---|---|---|---|---|
| 3,296,062 | A | 1/1967 | Truslow | |
| 3,322,163 | A | 5/1967 | Hughes | |
| 3,464,459 | A | 9/1969 | Ballard | |
| 3,486,791 | A | 12/1969 | Stoffel et al. | |
| 3,550,957 | A | 12/1970 | Radke et al. | |
| 3,756,288 | A | 9/1973 | Seo et al. | |
| 3,823,748 | A | 7/1974 | Allman et al. | |
| 3,872,895 | A | 3/1975 | Takada | |
| 3,926,227 | A | 12/1975 | Takada et al. | |
| 4,138,157 | A | 2/1979 | Pickett et al. | |
| 4,228,829 | A | 10/1980 | Kikuchi | |
| 4,710,423 | A | 12/1987 | Imamura | |
| 5,376,440 | A | 12/1994 | Koseki | |
| 5,547,143 | A | 8/1996 | Miller, III et al. | |
| 5,830,811 | A * | 11/1998 | Tang et al. | 442/216 |
| 5,869,582 | A | 2/1999 | Tang et al. | |
| 6,057,252 | A * | 5/2000 | Tang et al. | 442/216 |
| 6,071,835 | A | 6/2000 | Tang et al. | |
| 6,228,488 | B1 | 5/2001 | Tang et al. | |
| 6,312,806 | B1 * | 11/2001 | Tang et al. | 428/364 |
| 6,492,022 | B2 * | 12/2002 | Tang et al. | 428/364 |
| 2002/0018894 | A1 | 2/2002 | Weiming et al. | |

FOREIGN PATENT DOCUMENTS

| | | |
|---|---|---|
| JP | 1298209 | 12/1989 |
| JP | 4257336 | 9/1992 |
| JP | 7090717 | 4/1995 |

* cited by examiner

*Primary Examiner*—N. Edwards
(74) *Attorney, Agent, or Firm*—Rutan & Tucker, LLP

(57) ABSTRACT

An improved load leveling yarn has a force-displacement profile that maintains desirable properties of previously known yarns (as exemplified in U.S. Pat. No. 5,830,811), but exhibits a lower elongation at a stress that is greater than the IBS but less than or equal to 1.8 grams/denier. Especially preferred yarns are produced from PET with an IV of greater than 0.9 and epsilon caprolactone (at a ratio of about 90:10) under copolymerization conditions that allow reaction of at least 95% of the added epsilon caprolactone. Such yarns can then be formed into a web to form specific products, and especially seat belts.

46 Claims, 2 Drawing Sheets

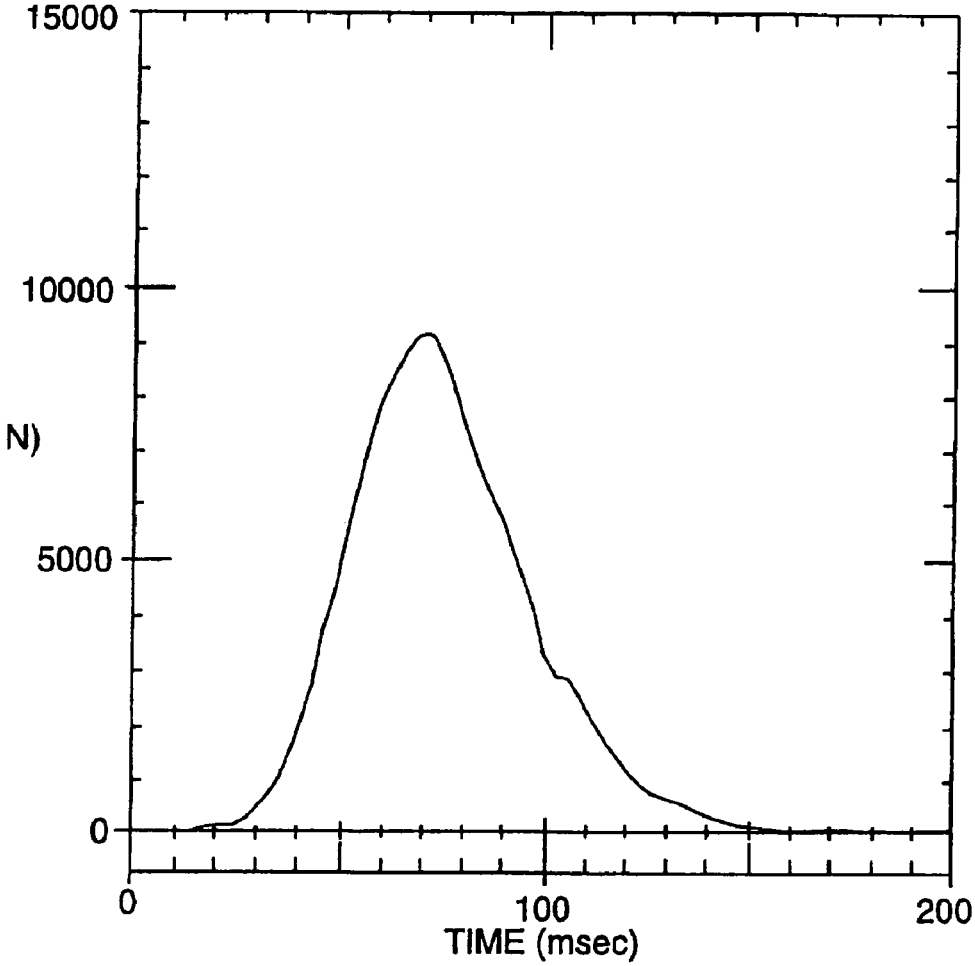
Prior Art Figure 1

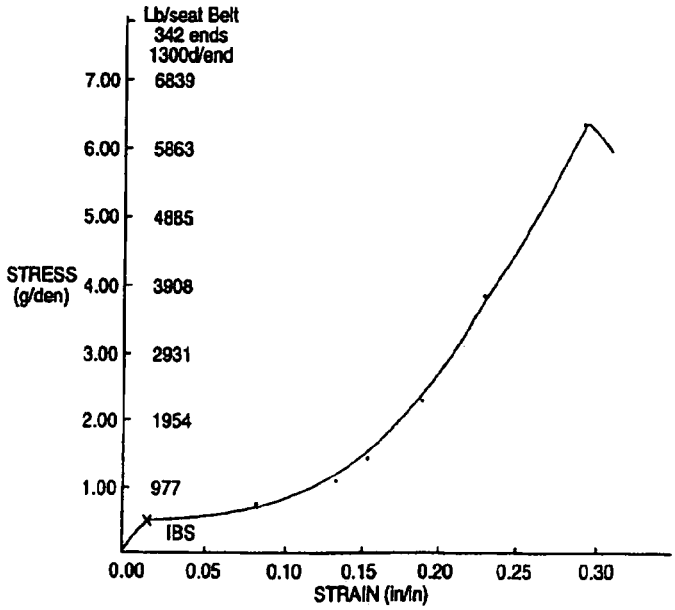
Prior Art Figure 2A
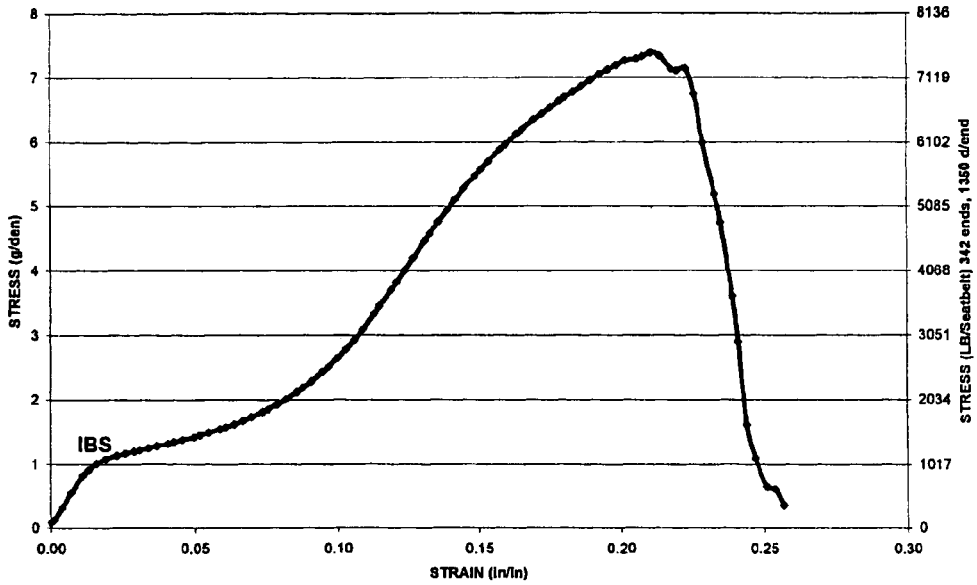
Figure 2B

LOAD LEVELING YARNS AND WEBBINGS

FIELD OF THE INVENTION

Compositions and methods for load leveling yarns and products produced therefrom.

BACKGROUND OF THE INVENTION

A typical vehicle safety seat belt system is intended to restrict the displacement of an occupant with respect to the occupant's seated position within the vehicle when the vehicle experiences a sudden, sharp deceleration (see e.g., commonly assigned U.S. Pat. No. 3,322,163. Most seat belt systems have three main portions: A retractor belt portion, a torso belt portion, and a lap belt portion, and the performance of each belt portion may be characterized by its force-displacement curve. The area under the force-displacement curve is referred to as the energy absorbed by the safety restraint.

Current vehicle safety seat belts are made from fully drawn polyethylene terephthalate ("PET") fiber which is partially relaxed (2.7%) and having a tenacity of at least 7.5 g/denier and is 14% elongation at break. However, various problems exists with current PET fiber seat belts. Among other things, crash studies indicate that after the initial vehicle impact occurs (e.g., speed of about 35 miles/hr), the occupant tends to move forward from his seated position until the belt engages to build restraining forces. As indicated in Prior Art FIG. 1, the relatively unyielding belt made from PET fiber exerts a load of at least 2000 pounds (about 9000 Newtons) against the occupant so as to cause the occupant to have chest and rib cage injuries at the seat belt torso position and also neck and back injuries when the occupant rebounds and impacts the back structure of the seat assembly.

U.S. Government regulation requires that seat belts must withstand loads up to 6,000 lbs. When a car collides at a speed of 35 miles/hour, an impact energy to which an average sized person in the car is subjected is at least 500 Joules on the torso belt. Although the current PET fiber may absorb the impact energy, damage to the vehicle occupant still occurs due to the undesirable force-displacement curve. In 70 milliseconds, an average sized passenger will experience high forces of up to 2,000 pounds (about 9,000 Newtons) as shown in FIG. 1.

In order to absorb the impact energy and to reduce the seat belt load against the vehicle occupant, U.S. Pat. No. 3,550,957 discloses a shoulder harness having stitched doubled sections of the webbing arranged above the shoulder of the occupant so that the stitching permits the webbing to elongate from an initial length toward a final length at a controlled rate under the influence of a predetermined restraining force. However, the stitched sections do not give the desirable amount of energy absorption, do not provide uniform response, and are not reusable. See also U.S. Pat. No. 4,138,157.

U.S. Pat. No. 3,530,904 discloses a woven fabric which is constructed by weaving two kinds of yarns having relatively different physical properties and demonstrates energy absorption capability. U.S. Pat. Nos. 3,296,062; 3,464,459; 3,756,288; 3,823,748; 3,872,895; 3,926,227; 4,228,829; 5,376,440; and Japanese Patent 4-257336 further disclose webbings which are constructed of multiple kinds of warp yarns having different tenacity and elongations at break. The webbing shows multiple step gives and impact absorbent characteristics. Those skilled in this technical area have recognized the deficiencies in using at least two different yarn types as taught by the preceding references. U.S. Pat. No. 4,710,423 and Kokai Patent Publication 298209 published Dec. 1, 1989 ("Publication 298209") teach that when using at least two different yarn types, energy absorption occurs in a stepwise manner and thus, the web does not absorb the energy continuously and smoothly. Therefore, after one type of warps absorbs a portion of the impact energy, and before another type of warps absorbs another portion of the impact energy, the human body is exposed to an undesirable shock. In addition, these types of seat belts are not reusable.

U.S. Pat. No. 3,486,791 discloses energy absorbing devices such as a rolled up device which separates a slack section of the belt from the taut body restraining section by clamping means which yield under a predetermined restraining force to gradually feed out the slack section so that the taut section elongates permitting the restrained body to move at a controlled velocity. The reference also describes a device which anchors the belt to the vehicle by an anchor member attached to the belt and embedded in a solid plastic energy absorber. These kinds of mechanical devices are expensive, are not reusable, provide poor energy absorption, and are difficult to control. An improvement on the foregoing devices is taught by commonly assigned U.S. Pat. No. 5,547,143 which describes a load absorbing retractor comprising: a rotating spool or reel, seat belt webbing secured to the reel; and at least one movable bushing, responsive to loads generated during a collision situation, for deforming a portion of the reel and in so doing dissipating a determined amount of the energy.

U.S. Pat. No. 4,710,423 and Publication 298209 disclose webbing comprised of PET yarns having tenacity of at least 4 grams/denier and an ultimate elongation of from 50% to 80%. Due to the inherent physical properties of PET yarn, the Examples show that, at 5% elongation, the load has already reached more than 700 kg (about 1500 lbs). The damage to the occupant by seat belt still exists and thus, the belt needs to be further modified. Examples in these two patents also show that if PET yarn is overrelaxed, the tenacity drops to 2.3 g/denier.

Kokai Patent Publication 90717 published Apr. 4, 1995 discloses high strength polybutylene terephthalate homopolymer ("PBT") fiber based energy absorption webbing. The fiber's tenacity is over 5.8 g/denier, breaking elongation is over 18.0%, and the stress at 10% elongation is less than 3.0 g/d. However, this reference fails to teach PBT fiber demonstrating the initial stress requirement which engages the seat belt to protect the occupant and the means to control the initial stress barrier.

Consequently, it would be desirable to have an improved energy absorbing seat belt which has a smoother performance than that of the known stitched webbing approach or the known use of at least two different fibers, is reusable unlike the known clamp approach, and also addresses the ability to control the initial barrier stress and the impact energy absorption. U.S. Pat. Nos. 5,830,811; 5,869,582; 6,071,835, 6,057,252 and 6,228,488 describe load leveling yarns, the copolymers from which they are made, the process by which they are made and the webbing in which they are utilized, which satisfy the requirement for a smooth energy absorbing seat belt.

Subsequent seat belt development work has elucidated the need for an energy absorbing seat belt which effectively absorbs the initial shock of a rapid deceleration, but with less total elongation as is described by the load leveling yarns of U.S. Pat. No. 5,830,811 and its seat belts. For example, in rapid deceleration situations, occupants of the 95 weight percentile, could in some applications designs elongate the load leveling yarns of U.S. Pat. No. 5,830,811 and its seat belts more than is acceptable for use in rear seats. It would therefore be desirable to have an improved seat belt with the energy absorbing performance of the load leveling yarns of U.S. Pat. No. 5,830,811, but with lower total elongation at the higher force loads produced by the heaviest occupants. Among other advantages, lower total elongation at higher force loads would prevent excessive excursion of heavier occupants into the back side of the front seats in a rapid deceleration situation.

Thus, while numerous compositions and methods for load leveling yarns and webbings are known in the art, all or almost all of them suffer from various disadvantages. Consequently, there is still a need to provide improved load leveling yarns and webbings.

SUMMARY OF THE INVENTION

The present invention is directed to yarns with improved force displacement profiles, and to various products formed from such yarns. Especially contemplated products include webs made from, or comprising the yarn, and seat belts comprising contemplated yarns.

In one preferred aspect of the inventive subject matter, contemplated yarns have a force displacement profile such that (a) when said yarn is subjected to an initial barrier stress of from about 0.2 gram/denier to less than or equal to about 1.4 grams/denier, said yarn elongates to less than 3 percent and the initial modulus ranges from about 20 grams/denier to about 150 grams/denier, (b) when that yarn is subjected to greater than said initial barrier stress and less than or equal to 1.8 grams/denier, the yarn elongates further to at least about 6 percent and the energy absorbed from 0 to the elongation at 1.8 grams/denier is at least about 0.0008 Joule/denier*meter, and (c) upon subjecting the yarn to greater than 1.8 grams/denier, the modulus increases sharply and the yarn elongates further until the yarn breaks at a tensile strength of at least about 5 grams/denier, wherein said yarn comprises a multiplicity of fibers, all of said fibers have substantially the same force-displacement profile, are made from polymers having a glass transition temperature in the range from about −10° C. to about +60° C., and are not made from polybutylene terephthalate homopolymer.

In further preferred aspects, the yarn may be fabricated from homopolymers (e.g., polytrimethylene terephthalate, polyisobutylene terephthalate, long chain alkylene terephthalate, or naphthalate polymers), or random copolymers, diblock copolymers, triblock copolymers, or segmented block copolymers, which will preferably include an aromatic polyester segment (e.g., PET, PEN, etc.) and a lactone monomer (e.g., epsilon-caprolactone, propiolactone, butyrolactone, or valerolactone). The lactone monomer is preferably present from about 5 to about 45 weight percent, and even more preferably from about 8 to about 15 weight percent.

Various objects, features, aspects and advantages of the present invention will become more apparent from the following detailed description of preferred embodiments of the invention.

BRIEF DESCRIPTION OF THE DRAWINGS

Prior Art FIG. 1 depicts the performance of a known PET seat belt at the torso position.

Prior Art FIG. 2A illustrates the force-displacement profile of a yarn and webbing that is manufactured according to a known process (U.S. Pat. No. 5,830,811).

FIG. 2B illustrates the force-displacement profile of a yarn and webbing that is manufactured using a process according to the inventive subject matter.

DETAILED DESCRIPTION

The inventors discovered processes and uses for load leveling yarns that solve at least some of the problems, and particularly excessive elongation under stress above initial barrier stress associated with heretofore known yarns. Webbings comprising such yarns, if used in seat belts, demonstrate different load leveling behavior from about 450 pounds (about 2,000 Newton) to about 1,800 pounds (about 8,000 Newton) in a vehicle collision. In order to meet these requirements, the web comprises warp yarn and the warp yarn has a force-displacement profile characterized by: (a) when the yarn is subjected to an initial barrier stress of from about 0.2 gram/denier to less than or equal to about 1.4 grams/denier, the yarn elongates to less than 3 percent and the initial modulus ranges from about 20 grams/denier to about 150 grams/denier; (b) upon subjecting the yarn to greater than the initial barrier stress and less than or equal to 1.8 grams/denier, the yarn elongates further to at least about 6 percent and the energy absorbed from 0 to the elongation at 1.8 grams/denier is at least 0.0008 Joule/denier-meter; and (c) upon subjecting the yarn to greater than 1.8 grams/denier, the modulus increases sharply and the yarn elongates further until the yarn breaks at a tensile strength of at least about 5 grams/denier, wherein the yarn comprises a multiplicity of fibers, all of said warp yarns having substantially the same force-displacement profile, are made from polymers having a glass transition temperature in the range from about −40° C. to about +70° C., and are not made from polybutylene terephthalate homopolymer. The term "modulus" as used herein-means the slope of the force-displacement curve.

It should be especially recognized that webs according to the inventive subject matter are particularly advantageous because of their improved impact energy absorption and smoother performance than that of the known stitched webbing approach or the known use of at least two different fibers. Furthermore, it should be appreciated that webs using contemplated yarns typically provide the ability to control the initial barrier stress and the impact energy absorption. In addition, the total elongation at higher stresses (between IBS and greater than 1.8 gm/denier) is limited at about 6 percent.

A particularly preferred yarn has the following force-displacement profile: (a) When the yarn is subjected to an initial barrier stress of from about 0.2 gram/denier to less than or equal to about 1.4 grams/denier, the yarn elongates to less than 3 percent. The initial modulus ranges from about 20 grams/denier to about 150 grams/denier and the preferred initial modulus ranges from about 50 grams/denier to about 150 grams/denier. The initial high modulus is needed to engage the seat belt and the height of the initial barrier stress ensures that all the occupant collision energy will be absorbed under the subsequent load leveling portion of the force-displacement curve.

(b) Upon subjecting the yarn to greater than the initial barrier stress and less than or equal to 1.8 grams/denier, the yarn elongates further to at least about 6 percent. Preferably, the yarn elongates from about 3 percent to at least about 20 percent and the energy absorbed from 0 to the elongation at 1.8 grams/denier is at least 0.0008 Joule/denier*meter. This portion of the force-displacement curve is the fiber load leveling portion which prevents the passenger from experiencing excessive loads.

(c) Upon subjecting the yarn to greater than 1.8 grams/denier, the modulus increases sharply and the yarn elongates further until the yarn breaks at a tensile strength of at least about 5 grams/denier. In a seat belt assembly comprising the foregoing yarn, the load on the passenger's torso position may be reduced to as low as 450 lbs (about 2,000 Newton) even at a collision speed of 35 miles/hour. The reduced force then minimizes or eliminates potential damage to the passenger.

Such yarn is preferably made from a polymer having a glass transition temperature in the range from about −40° C. to about +70° C., more preferably about −20° to about +60° C., and most preferably about −11° C. to about +60° C. It should be recognized that the glass transition temperature will at least in part depend on the particular polymer composition, and it is therefore contemplated that all compositions with the contemplated Tg ranges are considered suitable for use herein. However, it is especially preferred that the polymer has a Tg of between about +50° C. and +60° C. (e.g., about +56° C.) and comprises a homopolymer, random copolymer, diblock copolymer, triblock copolymer, or segmented block copolymer. Examples of particularly preferred homopolymers include polytrimethylene terephthalate, polyisobutylene terephthalate, long chain alkylene terephthalates, and naphthalate polymers.

Examples of preferred random copolyesters include copolyesters which, in addition to the ethylene terephthalate unit, contain components such as ethylene adipate, ethylene sebacate, or other long chain alkylene terephthalate units. Such components are preferably present in an amount of 10 percent, or more. Most preferably, the copolyester is formed with an aliphatic polyester (e.g., epsilon caprolactone at an amount of between about 8–15%, and most preferably about 10%).

Examples of preferred block copolymers include diblock, triblock, and segmented block structure. Block copolymers comprise at least one hard crystalline aromatic polyester block and at least one soft amorphous aliphatic polyester block. The crystalline aromatic polyester includes the homopolymers such as polyethylene terephthalate; polytrimethylene terephthalate; polybutylene terephthalate; polyisobutylene terephthalate; poly(2,2-dimethylpropylene terephthalate); poly[bis-(hydroxymethyl)cyclohexene terephthalate]; polyethylene naphthalate; polybutylene naphthalate; poly[bis-(hydroxymethyl)cyclohexene naphthalate]; other polyalkylene or polycycloalkylene naphthalates and the mixed polyesters which, in addition to the ethylene terephthalate unit, contain component such as ethylene isophthalate; ethylene adipate; ethylene sebacate; 1,4-cyclohexylene dimethylene terephthalate; or other long chain alkylene terephthalate units. A mixture of aromatic polyesters may also be used. The more preferred aromatic polyesters include PET and PEN. As for amorphous aliphatic polyester block, it is made from lactone monomer. epsilon-caprolactone is the most preferable. In addition, propiolactone, butyrolactone, valerolactone, higher cyclic lactones, and two or more types of lactones may also be used. When PBT is used, the amorphous aliphatic polyester block is present in an amount greater than 10 percent.

With respect to diblock polyester copolymers and processes for making same, commonly owned U.S. Pat. No. 5,869,582 (which is a CIP of application Ser. No. 08/788,895 filed Jan. 22, 1997) is incorporated herein by reference.

Examples of preferred diblock copolymers include those comprising (a) a first block of polyester wherein the first block is made from aromatic polyester and (b) a second block of polyester wherein the second block is made from lactone monomer. More preferably, the aromatic polyester has: (i) an intrinsic viscosity which is measured in a 60/40 by weight mixture of phenol and tetrachloroethane and is at least about 0.6 deciliter/g and (ii) a Newtonian melt viscosity of at least about 7,000 poises at 280° C. Examples of preferred aromatic polyesters include polyethylene terephthalate ("PET"), polyethylene naphthalate ("PEN"); polybutylene terephthalate ("PBT"); polybutylene naphthalate; poly[bis-(hydroxymethyl)cyclohexene terephthalate]; poly [bis-(hydroxymethyl)cyclohexene naphthalate]; polytrimethylene terephthalate; polyisobutylene terephthalate; poly (2,2-dimethylpropylene terephthalate); other polyalkylene or polycycloalkylene naphthalates and the mixed polyesters which in addition to the ethylene terephthalate unit, contain components such as ethylene isophthalate, ethylene adipate, ethylene sebacate, 1,4-cyclohexylene dimethylene terephthalate, or other alkylene terephthalate units. A mixture of aromatic polyesters may also be used. Commercially available aromatic polyesters may be used. The more preferred aromatic polyesters include PET and PEN. The intrinsic viscosities ("IV"), as measured in a 60/40 by weight mixture of phenol and tetrachloroethane, of the preferred aromatic polyesters are about 0.8 for PET and about 0.6 for PEN. However, more preferred IV for PET is 0.97 and for PEN is 0.8. Preferred lactones include epsilon-caprolactone, propiolactone, butyrolactone, valerolactone, and higher cyclic lactones. Two or more types of lactones may be used simultaneously.

For use in load leveling seat belts, the PET-polycaprolactone diblock copolymer may have a polycaprolactone concentration of preferably about 5 to about 45 weight percent, and more preferably about 8 to about 15 weight percent. In the diblock copolymer, the polycaprolactone concentration may be varied to achieve the desired initial barrier stress and impact energy absorption with load leveling performance.

Catalysts used in the polymerization of lactones may be used in the diblock copolymerization. Preferred catalysts are organometallics based on metals such as lithium, sodium, potassium, rubidium, cesium, magnesium, inorganic acid salts, oxides organic acid salts and alkoxides of calcium, barium, strontium, zinc, aluminum, titanium, cobalt, germanium, tin, lead, antimony, arsenic, cerium, boron cadmium and manganese; and their organometallic complexes. More preferred catalysts are organic acid salts and organometallic compounds of tin, aluminum and titanium. The most preferred catalysts are tin diacylate, tin tetra acylate, dibutyltin oxide, dibutyltin dilaurate, tin octanoate, tin tetra acetate, triisobutyl aluminum, tetra butyl titanium, germanium dioxide, antimony trioxide, porphyrin and phthalocyanine complexes of these metals. Two or more catalyst types may be used in parallel. Useful catalysts are commercially available. Preferably, the amount of catalyst used is about 0.002 to about 0.2 weight percent based on the combined weight of the aromatic polyester and lactone monomer.

In a preferred manner of manufacture, the aromatic polyester is added to an extruder. The aromatic polyester may be added to the extruder in a melt phase as from a melt polymerization reactor, or the aromatic polyester may be added to the extruder in a chip form and then melted in the extruder. Unexpectedly, the inventors discovered that mixing and reaction of the polymeric melt with material having a drastic viscosity difference become feasible to produce the yarns according to the inventive subject matter when the extruder is a twin screw extruder.

Suitable twin screw extruders can be either intermeshing counter-rotating or intermeshing co-rotating, both of which provide good dispersive mixing, tight residence time distribution, and effective devolatilization. The screw profile is preferably configured to allow polyester feeding (either in a pellet form or molten form), polyester melting (if pellets are feed), lactone monomer injection, mixing, reaction, devolatilization, and finally pelletization or spinning. The inventors further recognized that the most efficient dispersive and distributive mixing occurs at the position where the lactone monomer is injected into the polyester melt.

The initial extrusion temperature exceeds the melting point (as measured by Perkin-Elmer Differential Scanning Calorimeter (DSC) from the maxima of the endotherm resulting from scanning a 2 mg. sample at 20° C. per minute) of the aromatic polyester used. The melting points of the preferred aromatic polyesters are 250° C. for PET and 266° C. for PEN. The preferred initial extrusion zone temperature is at least about 30° C. above the aromatic polyester melting point. Thus, the preferred initial extrusion temperature for PET is at least about 280° C. while the preferred initial extrusion temperature for PEN is at least about 296° C. In cases where the aromatic polyester is fed to the twin screw extruder in a molten form, it is generally preferred that the initial extrusion zone temperature is approximately 10° C. above the aromatic polyester melting point. To promote the diblock copolymer formation and minimize transesterification occurrence, the residence time and extrusion temperature profile are important.

After the aromatic polyester is melted, the melt temperature is decreased preferably by at least about 20° C. and more preferably by at least about 50° C. due to the mixing with the injected lactone monomer and catalyst. Preferably, the catalyst is added to the epsilon-caprolactone monomer at room temperature and the epsilon-caprolactone monomer/catalyst mixture is injected into the melted aromatic polyester. Thus, the reactive extrusion temperature for PET is preferably about 260° C. and more preferably about 200 C to about 240° C. while the reactive extrusion temperature for PEN is preferably about 276° C. and more preferably about 246 to about 276° C.

The term "residence time" in the extruder as used herein means the extruder volume divided by the output rate. The aromatic polyester and lactone are extruded at a residence time of less than about 30 minutes and at a temperature sufficient to form the diblock copolymer. The preferred residence time is less than about 15 minutes. The more preferred residence time is less than about 10 minutes and the most preferred residence time is less than about 5 minutes. This short residence time minimizes transesterification while ensuring complete polymerization which means to graft the epsilon-caprolactone monomer to form the block at the PET chain end and complete consumption of the injected epsilon-caprolactone monomer. Turbulators are used to increase extruder volume without sacrificing the throughput rate and to control the residence reaction time. To determine residence distribution, we added colored pellets which served as a marker to the polyester pellets. The term "distribution time" means the range starting from the color appearance and ending at color disappearance. As those skilled in the art know, as the distribution time decreases, product uniformity increases. Thus, the preferred distribution time is less than about 4 minutes. The distribution time is more preferably less than about 2 minutes and most preferably less than about 1 minutes.

The fiber formation may be achieved by spinning either directly from twin screw extruder or separately from single screw extruder. Both processes consist of extrusion, spinning, drawing and relaxing stages. In the twin screw extruder, reaction and compounding may be conducted in polymer melt with a proper screw profile and process conditions. In the single screw extruder, the polymer pellets may be fed and melted with proper screw design and process conditions. A homogeneous melt is then fed into a spin pot which contains a screen pack and a spinneret. The extruded filaments go through a heated sleeve, are quenched in a cross-flow quench system using conditioned air at a predetermined rate, and taken up by godet at a certain speed. The as-spun yarn is then drawn to its optimum draw ratio to obtain the maximum strength. The relaxation stage shrinks the yarn and produces a yarn with the desired stress-strain curve. Fiber relaxation affects the maximum load which the passenger will experience in the vehicle collision. For example, using a PET/25% Polycaprolactone diblock copolymer, the load experienced by the passenger may change from about 1,500 pounds to about 900 pounds when the fully drawn fiber is relaxed from 5% to 15%.

Depending upon the intended use of the present web, additives such as UV stabilizers may be used in or on the fiber. The term "multiplicity of fibers" as used herein means at least two ends of yarn and preferably, at least about 342 ends for seat belts.

Seat belts are usually woven with a warp yarn of about 1000 to about 1500 denier and a breaking strength of at least about 5 grams/denier and weft yarn with a denier of about 500 to 900 and a breaking strength of at least about 5 grams/denier. Weaving conditions are selected in order for the seat belt to preserve the stress/strain properties of the yarn and maintain the webbing strength. Our results indicate that the most desirable weaving pattern for energy absorption is a 2×2 twill webbing.

The present web provides the desired load-leveling characteristics in the absence of a clamping device such as taught by U.S. Pat. No. 3,486,791; stitching such as taught by U.S. Pat. No. 3,550,957; and a mechanical energy absorbing device such as the constant force retractor taught by commonly assigned U.S. Pat. No. 5,547,143. The present web and yarn provide the desired load-leveling characteristics and are made from material other than the PBT homopolymer taught by Publication 90717. The present web provides the desired load-leveling characteristics by using warp yarns having substantially the same force-displacement profile instead of the plurality of warp yarn force-displacement profiles taught by U.S. Pat. Nos. 3,756,288; 3,823,748; 3,872,895; 4,288,829; and 5,376,440. The present web provides the desired load-leveling characteristics and is made from polymer other than the PET homopolymer taught by U.S. Pat. No. 4,710,423 and Publication 298209. Therefore, contemplated webs comprising the yarns according to the inventive subject matter as particularly useful for seat belts.

EXAMPLES

The following examples are intended to be illustrative and not limiting to the subject matter. Therefore, numerous components, steps, and/or conditions may be modified without departing from the inventive concept presented herein.

Comparative Example (1)

Dried PET pellets (IV=0.9; MV=15,000 poises at 280° C.) were fed into a counter-rotation twin screw extruder (diameter=27 mm, length=1404 mm) at the rate of 12 lbs/hr. The length of one zone was about 4 times the screw diameter. The pellets started to melt and were advanced forward by a pumping element. After PET melted, the premixed epsilon-caprolactone and catalyst (tin octonate, 0.09 wt % of PET-caprolactone) were injected by a piston pump into the extruder into the melt at the rate of 4 lbs/hr. A forwarding mixer was located under the injection point. The injected liquid was mixed with PET melt by both distributive and dispersive mixers. The mixture of PET and epsilon-caprolactone was then forwarded into reaction zones and the reaction was completed with a residence time of 3.7 minutes. At the end of polymerization, the melt was devolatilized by a vacuum. The stress-strain curve for the yarn, as well as the seat belt which could be made from that yarn, is shown in FIG. 2A.

The extrusion conditions for the comparative example are given in Table I. The polymer melt (e.g., PET (75%)-polycaprolactone (25%)) was then either fed into a spin pot which contained a spinneret to form fibers, or extruded through a three hole die, quenched into water, and cut into pellets. The diblock copolymer had a melting point of 231° C. and an IV=0.98 which demonstrates that the PET copolymerized with epsilon-caprolactone. Chemical composition of the polymers are indicated in Table II.

Inventive Example (2)

High viscosity molten PET (IV>0.9) was fed from a high viscosity, melt PET reactor directly into the feed of a twin screw extruder. The twin screw extruder in this example is a counter rotating 67 mm twin screw, but co-rotating twin screws have been designed to produce similar results. The high viscosity molten PET was metered precisely to the twin screw extruder by a gear type metering pump at the rate of approximately 252 lb/hour. The twin screw extruder had an overall L/D of approximately 38/1 and was comprised of 5 processing sections: a) molten PET feed, b) co-monomer injection and mixing, c) copolymerization reaction section, d) vacuum stripping of residual monomer, and e) pressure build for discharge. An injection port in the co-monomer injection and mixing section allowed injection of approximately 28 lb/hr of room temperature epsilon-caprolactone, which was precisely metered by high pressure metering pumps. Mixed with the epsilon-caprolactone feed was 0.000275 tin octonate by % weight of the PET/epsilon-caprolactone copolymer. The epsilon-caprolactone was quickly mixed with the PET melt by both distributive and dispersive mixers. The PET and epsilon-caprolactone mixture was then forwarded into the copolymerization reaction zones where the reaction was completed resulting in reaction of at least 95% of all the epsilon-caprolactone.

At the end of the polymerization section, the melt was devolatilized by vacuum. The polymer melt (PET (90%)-polycaprolactone (10%)) was then fed pumped from the extruder and fed by means of a transfer pump to spin pumps in parallel. The diblock copolymer had a melting point of at least 220° C. and an IV of about 1.0 IV, which demonstrates that the PET had copolymerized with epsilon-caprolactone. Each of the spin pumps pumped the copolymer through a spinneret with 100 round holes. The filaments went through a heated sleeve and were quenched by uniformly controlled air. The undrawn, spun yarn was coated with a spin finish and taken by a godet at a certain speed before passing to subsequent godet rolls prior to being taken onto a package by a winder. The filament bundle from the first godet, was drawn onto a heated godet at 135° C., and then relax about 8 percent before being entangled and taken onto a package by a winder.

The stress-strain curve for the yarn, as well as the seat belt which could be made from that yarn, is shown in FIG. 2B. The yarn in this example demonstrates a similar initial barrier stress (IBS) at low stress, about 1 gram/denier in this example, as is shown in the comparative example above (see also FIG. 2A). This low IBS behavior is highly valuable for shock absorption when used as warp yarn in a web. However, at 1.8 gram/denier stress, the yarn in this example elongates significantly less, to about 7% in this example, as compared to the example shown below where the elongation at 1.8 grams/denier stress is about 17%. Likewise, the total elongation of the current example, as shown in FIG. 2B, is limited to less than 25%. The breaking tensile strength is about 7.3 grams/denier in the current example.

Test Procedures

Tenacity is measured on an Instron equipped with two grips which hold the yarns at the gauge lengths of 10 inches. The yarn is then pulled by the strain rate of 12 inch/minute, the data are recorded by a load cell, and stress-strain curves are obtained. Tenacity is the breaking strength (in grams) divided by the yarn's denier.

Thus, specific embodiments and applications of improved load leveling yarns and webbings have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

TABLE I

| Example | Zone 1(° C.) | Zone 2(° C.) | Zone 3(° C.) | Zone 4(° C.) | Zone 5(° C.) | Zone 6(° C.) | Zone 7(° C.) | Zone 8(° C.) | Zone 9(° C.) | Zone 10(° C.) | Zone 11(° C.) | Zone 12(° C.) | Zone 13(° C.) |
|---|---|---|---|---|---|---|---|---|---|---|---|---|---|
| 1A | 292 | 290 | 260 | 250 | 250 | 245 | 245 | 240 | 240 | 240 | 252 | 242 | 240 |
| 1B | 292 | 290 | 255 | 255 | 245 | 240 | 240 | 235 | 235 | 235 | 235 | 235 | 235 |

| Example | Screw Speed (RPM) | Torque | Melt Temperature (° C.) | Melt Pressure (psi) | Vacuum (mbar) | Throughput (lbs/hr) | Residence Time (min) | Residence Time Distribution (min) |
|---|---|---|---|---|---|---|---|---|

TABLE I-continued

| | | | | | | | | |
|---|---|---|---|---|---|---|---|---|
| 1A | 150 | 55 | 264 | 90 | −750 | 5 | 12 | Not determined |
| 1B | 150 | 48 | 256 | 60 | −1000 | 16 | 3.7 | 1 |

Zone temperature had negligible deviation from set points.

TABLE II

| Example | ϵ-Caprolactone (%) | Unreacted ϵ-Caprolactone (%) | Diblock Copolymer Intrinsic Viscosity (dl/g) | Transesterification in Diblock Copolymer (%) |
|---|---|---|---|---|
| 1A | 15 | 0 | 0.94 | 6 |
| 1B | 25 | 0 | 0.98 | 5 |

What is claimed is:

1. A yarn having a force-displacement profile such that:

(a) when said yarn is subjected to an initial barrier stress of from about 0.2 gram/denier to less than or equal to about 1.4 grams/denier, said yarn elongates to less than 3 percent and the initial modulus ranges from about 20 grams/denier to about 150 grams/denier;

(b) upon subjecting said yarn to greater than said initial barrier stress and less than or equal to 1.8 grams/denier, said yarn elongates further to an amount of no more than about 10 percent at less than or equal to 1.8 grams/denier, and the energy absorbed from 0 to the elongation at 1.8 grams/denier is at least about 0.0008 Joule/denier*meter; and (c) upon subjecting said yarn to greater than 1.8 grams/denier, the modulus increases sharply and said yarn elongates further until said yarn breaks at a tensile strength of at least about 5 grams/denier and a total elongation of less than 25 percent, wherein said yarn comprises a multiplicity of fibers, all of said fibers have substantially the same force-displacement profile, are made from polymers having a glass transition temperature in the range from about −10° C. about +60° C., and are not made from polybutylene terephthalate homopolymer.

2. The yarn of claim 1 wherein said yarn in part (a) elongates to less than about 2 percent, and in part (b) elongates to less than about 7 percent.

3. The yarn of claim 1 wherein said yarn is made from homopolymers, random copolymers, diblock copolymers, triblock copolymers, or segmented block copolymers.

4. The yarn of claim 3 wherein said yarn is made from a homopolymer selected from the group consisting of polytrimethylene terephthalate; polyisobutylene terephthalate; and long chain alkylene terephthalate and naphthalate polymers.

5. The yarn of claim 3 wherein said yarn is made from a diblock copolymer.

6. The yarn of claim 1 wherein said yarn is made from a diblock copolymer, triblock copolymer, or segmented block copolymer comprising:

(a) at least one first block of polyester wherein said first block is made from an aromatic polyester and (b) at least one second block of polyester wherein said second block is made from lactone monomer.

7. The yarn of claim 5 wherein said diblock copolymer comprises:

(a) a first block of polyester wherein said first block is made from an aromatic polyester and (b) a second block of polyester wherein said second block is made from lactone monomer.

8. The yarn of claim 6 wherein said aromatic polyester is selected from the group consisting of polyethylene terephthalate, polyethylene naphthalate, polyalkylene naphthalates, polycycloalkylene naphthalates, polybutylene terephthalate, and polytrimethylene terephthalate.

9. The yarn of claim 7 wherein said aromatic polyester is selected from the group consisting of polyethylene terephthalate, polyethylene naphthalate, polyalkylene naphthalates, polycycloalkylene naphthalates, polybutylene terephthalate, and polytrimethylene terephthalate.

10. The yarn of claim 6 wherein said aromatic polyester is polyethylene terephthalate.

11. The yarn of claim 7 wherein said aromatic polyester is polyethylene terephthalate.

12. The yarn of claim 6 wherein said lactone monomer is selected from the group consisting of epsilon-caprolactone, propiolactone, butyrolactone, and valerolactone.

13. The yarn of claim 7 wherein said lactone monomer is selected from the group consisting of epsilon-caprolactone, propiolactone, butyrolactone, and valerolactone.

14. The yarn of claim 12 wherein the amount of said lactone monomer is from about 5 to about 45 weight percent so as to achieve the desired initial barrier stress and impact energy absorption with load leveling performance.

15. The yarn of claim 13 wherein the amount of said lactone monomer is from about 10 to about 45 weight percent so as to achieve the desired initial barrier stress and impact energy absorption with load leveling performance.

16. A web comprising a warp yarn, said yarn having a force-displacement profile such that:

(a) when said yarn is subjected to an initial barrier stress of from about 0.2 gram/denier to less than or equal to about 1.4 grams/denier, said yarn elongates to less than 3 percent and the initial modulus ranges from about 20 grams/denier to about 150 grams/denier;

(b) upon subjecting said yarn to greater than said initial barrier stress and less than or equal to 1.8 grams/denier, said yarn elongates further to an amount of no more than about 10 percent at less than or equal to 1.8 grams/denier, 1 and the energy absorbed from 0 to the elongation at 1.8 grams/denier is at least about 0.0008 Joule/denier*meter; and (c) upon subjecting said yarn to greater than 1.8 grams/denier, the modulus increases sharply and said yarn elongates further until said yarn breaks at a tensile strength of at least about 5 grams/denier and a total elongation of less than 25 percent, wherein said yarn comprises a multiplicity of fibers, all of said warp yarns having substantially the same force-displacement profile, are made from polymer having a glass transition temperature in the range from about −10° C. to about +60° C., and are not made from polybutylene terephthalate homopolymer.

17. The web of claim 16 wherein said yarn in part (a) elongates to less than about 2 percent, and in part (b) elongates to less than about 7 percent.

18. The web of claim 16 wherein said yarn is made from homopolymers, random copolymers, diblock copolymers, triblock copolymers, or segmented block copolymers.

19. The web of claim 18 wherein said yarn is made from homopolymer selected from the group consisting of polytrimethylene terephthalate; polyisobutylene terephthalate; and long chain alkylene terephthalate and naphthalate polymers.

20. The web of claim 18 wherein said yarn is made from a diblock copolymer.

21. The web of claim 16 wherein said yarn is made from a diblock copolymer, triblock copolymer, or segmented block copolymer comprising:

(a) at least one first block of polyester wherein said first block is made from an aromatic polyester and (b) at least one second block of polyester wherein said second block is made from lactone monomer.

22. The web of claim 20 wherein said diblock copolymer comprises:

(a) a first block of polyester wherein said first block is made from an aromatic polyester and (b) a second block of polyester wherein said second block is made from lactone monomer.

23. The web of claim 21 wherein said aromatic polyester is selected from the group consisting of polyethylene; terephthalate; polyethylene naphthalate; polyalkylene naphthalates; polycycloalkylene naphthalates; polybutylene terephthalate; and polytrimethylene terephthalate.

24. The web of claim 22 wherein said aromatic polyester is selected from the group consisting of polyethylene terephthalate; polyethylene naphthalate; polyalkylene naphthalates; polycycloalkylene naphthalates; polybutylene terephthalate; and polytrimethylene terephthalate.

25. The web of claim 21 wherein said aromatic polyester is polyethylene terephthalate.

26. The web of claim 22 wherein said aromatic polyester is polyethylene terephthalate.

27. The web of claim 21 wherein said lactone monomer is selected from the group consisting of epsilon-caprolactone, propiolactone, butyrolactone, and valerolactone.

28. The web of claim 22 wherein said lactone monomer is selected from the group consisting of epsilon-caprolactone, propiolactone, butyrolactone, and valerolactone.

29. The web of claim 27 wherein the amount of said lactone monomer is from about 5 to about 45 weight percent so as to achieve the desired initial barrier stress and impact energy absorption with load leveling performance.

30. The web of claim 28 wherein the amount of said lactone monomer is from about 5 to about 45 weight percent so as to achieve the desired initial barrier stress and impact energy absorption with load leveling performance.

31. A seat belt made from said web of claim 16.

32. A method of restraining a vehicle occupant in a vehicle collision comprising the step of:

using an impact energy absorption and load leveling web which restrains said vehicle occupant with force from about 450 pounds (about 2,000 Newtons) to about 1,800 pounds (about 8,000 Newtons) and comprises warp yarn, said yarn having a force-displacement profile such that:

(a) when said yarn is subjected to an initial barrier stress of from about 0.2 gram/denier to less than or equal to about 1.4 gram/denier, said yarn elongates to less than 3 percent and the initial modulus ranges from about 20 grams/denier to about 150 grams/denier;

(b) upon subjecting said yarn to greater than said initial barrier stress and less than or equal to 1.8 grams/denier, said yarn elongates further to an amount of no more than about 10 percent at less than or equal to 1.8 grams/denier, and the energy absorbed from 0 to the elongation at 1.8 grams/denier is at least about 0.0008 Joule/denier*meter; and (c) upon subjecting said yarn to greater than 1.8 grams/denier, the modulus increases sharply and said yarn elongates further until said yarn breaks at a tensile strength of at least about 5 grams/denier and a total elongation of less than 25 percent, wherein said yarn comprises a multiplicity of fibers, all of said warp yarns have substantially the same force-displacement profile, are made from polymers having a glass transition temperature in the range from about −10° C. to about +60° C., and are not made from polybutylene terephthalate homopolymer.

33. The method of claim 32 wherein said yarn in part (a) elongates to less than about 2 percent, and in part (b) elongates to less than about 7 percent.

34. The method of claim 32 wherein said yarn is made from homopolymers, random copolymers, diblock copolymers, triblock copolymers, or segmented block copolymers.

35. The method of claim 34 wherein said yarn is made from homopolymer selected from the group consisting of polytrimethylene terephthalate; polyisobutylene terephthalate; and long chain alkylene terephthalate and naphthalate polymers.

36. The method of claim 34 wherein said yarn is made from a diblock copolymer.

37. The method of claim 32 wherein said yarn is made from a diblock copolymer, triblock copolymer, or segmented block copolymer comprising:

(a) at least one first block of polyester wherein said first block is made from an aromatic polyester and (b) at least one second block of polyester wherein said second block is made from lactone monomer.

38. The method of claim 36 wherein said diblock copolymer comprises; (a) a first block of polyester wherein said first block is made from an aromatic polyester and (b) a second black of polyester wherein said second block is made from lactone monomer.

39. The method of claim 37 wherein said aromatic polyester is selected from the group consisting of polyethylene terephthalate; polyethylene naphthalate; polyalkylene naphthalates; polycycloalkylene naphthalates; polybutylene terephthalate; and polytrimethylene terephthalate.

40. The method of claim 38 wherein said aromatic polyester is selected from the group consisting of polyethylene terephthalate; polyethylene naphthalate; polyalkylene naphthalates; polycycloalkylene naphthalates; polybutylene terephthalate; and polytrimethylene terephthalate.

41. The method of claim 37 wherein said aromatic polyester is polyethylene terephthalate.

42. The method of claim 38 wherein said aromatic polyester is polyethylene terephthalate.

43. The method of claim 37 wherein said lactone monomer is selected from the group consisting of epsilon-caprolactone, propiolactone, butyrolactone, and valerolactone.

44. The method of claim 38 wherein said lactone monomer is selected from the group consisting of epsilon-caprolactone, propiolactone, butyrolactone, and valerolactone.

45. The method of claim 43 wherein the amount of said lactone monomer is from about 5 to about 45 weight percent so as to achieve the desired initial barrier stress and load leveling performance.

46. The method of claim 44 wherein the amount of said lactone monomer is from about 5 to about 45 weight percent so as to achieve the desired initial barrier stress and load leveling performance.

* * * * *